United States Patent [19]

Parsons

[11] 4,227,628

[45] Oct. 14, 1980

[54] FLUID DISPENSING PUMP HAVING AXIALLY DEFORMABLE VALVE

[76] Inventor: Frederick L. Parsons, 759 Morningside Rd., Ridgewood, N.J. 07450

[21] Appl. No.: 14,346

[22] Filed: Feb. 23, 1979

[51] Int. Cl.[3] ..... B05B 11/02

[52] U.S. Cl. ..... 222/380; 222/383; 239/333; 417/566

[58] Field of Search ..... 239/331, 333; 417/558, 417/560, 566, 571; 222/320, 321, 380, 384, 385, 383

[56] References Cited

U.S. PATENT DOCUMENTS

| | | | |
|---|---|---|---|
| 3,162,334 | 12/1964 | Miller . | |
| 3,507,586 | 4/1970 | Gronemeyer et al. | 222/321 X |
| 3,527,551 | 9/1970 | Kutik et al. . | |
| 3,730,217 | 5/1973 | Gute | 417/566 X |
| 3,908,870 | 9/1975 | Nozawa et al. . | |
| 3,923,250 | 12/1975 | Boris . | |
| 4,046,292 | 9/1977 | Corsette . | |
| 4,079,865 | 3/1978 | Kutik | 222/385 X |
| 4,084,731 | 4/1978 | Ayres . | |

OTHER PUBLICATIONS

Vernay Laboratories, Inc., Trade Literature: (No Date).

*Primary Examiner*—David A. Scherbel

*Attorney, Agent, or Firm*—Brumbaugh, Graves, Donohue and Raymond

[57] ABSTRACT

In the illustrative embodiments of the invention disclosed, a non-aerosol pump includes a housing, a barrel within the housing forming a valve chamber, a pumping chamber within the barrel, a valve gland within the valve chamber for controlling intake and discharge flow to and from the pumping chamber, and a hand or finger-operated plunger for operating the pump. The valve gland has a circular seal lip on its axially outer surface for establishing a circular seal around the opening from the valve chamber to the pumping chamber. As pressure within the pumping chamber exceeds and falls below predetermined limits, the valve gland snaps open and closed, respectively, to provide a sharp on-off spray discharge. The check valve for controlling flow from the container to the pumping chamber may be formed integrally with the valve gland and of the same material or, alternatively, may comprise a ball check valve located within the gland.

7 Claims, 5 Drawing Figures

FLUID DISPENSING PUMP HAVING AXIALLY DEFORMABLE VALVE

FIELD OF THE INVENTION

The present invention relates in general to non-aerosol pumps for dispensing fluids from a container in the form of a spray and, more specifically, to an improved and economical construction for a hand or finger-operated pump of the type referred to which may be attached to containers of diverse sizes and shapes and which affords sharp on-off spray control.

THE PRIOR ART

As is well known, many products ranging over such diverse product fields as foodstuffs to insecticides are packaged in spray-dispensing containers. There has accordingly been great interest in the development of low cost, efficient devices for dispensing such products. In earlier years, pressurized aerosol containers were utilized to a great degree, but more recently the detrimental effect on the atmosphere of the widespread use of the propellants typically employed in such devices has led to still more emphasis in the development of non-aerosol dispensing devices. Many such devices have been proposed, but heretofore none has proven to be entirely satisfactory owing to one or more factors. These factors include too many and/or too costly parts, complicated and costly assembly procedures, expensive materials, and inefficient or unreliable operation, such as inadequate atomization and pre or post-spray dripping when liquids are dispensed. The present invention concerns an improved non-aerosol pump for overcoming these and other disadvantages of the prior art.

SUMMARY

In accordance with the invention, a fluid dispensing pump includes a housing adapted to be connected to a container holding a fluid to be dispensed, a barrel within the housing for defining a valve chamber, a pumping chamber within the barrel having a generally central opening to the valve chamber, a valve gland within the valve chamber for controlling fluid flow from the container to and from the pumping chamber through the opening therebetween, and a hand or finger-operated plunger for operating the pump. The valve gland preferably comprises a generally cylindrical resilient element having a central check-valve operated passageway therein for providing one-way flow from the container to the pumping chamber and a generally circular sealing lip on the side thereof adjacent the pumping chamber for establishing a fluid tight seal in surrounding relation to the opening between the valve and pumping chambers. In its relaxed state, with the plunger out, the valve gland is urged against the facing wall of the pumping chamber, thereby preventing fluid flow to the discharge port. The fluid pressure within the pumping chamber initially acts only across the gland area encompassed by the sealing lip. Upon the build up of fluid pressure on reciprocation of the plunger to the point where it overcomes the resilience of the valve gland, the gland snaps away from sealing relation with the pumping chamber and provides a sharp, full-strength spray discharge. In the open position, the entire cross sectional area of the gland is exposed to the pump chamber pressure. This not only assures that the valve gland will open sharply, but also that it will be held fully open until the fluid pressure has fallen below that level at which the force exerted on the gland by the fluid is less than the resilient force tending to restore the gland to the relaxed, or closed, position. The gland thereupon snaps closed, restoring the seal around the opening to the pumping chamber and abruptly shutting off the spray discharge.

In one embodiment, the check valve is integrally formed with the valve gland and is of the same material. This construction permits the elimination of all metal-fluid contact within the pump, a feature of advantage in the dispensing of fluids incompatible with metals. It has the further advantage of providing a pump which requires only three basic plastic parts, i.e., the housing, the barrel and the plunger, and one rubber part, the valve gland. As will be appreciated, this affords a pump construction that is quite economical both as to cost of manufacture and as to cost of assembly. Moreover, it has basically only two moving parts, the plunger and the valve gland. This further simplifies the construction and operation of the pump.

For those applications where a ball-type check valve is desired, the invention readily lends itself to the incorporation of this type of check valve into the valve gland, and with the addition of only one more part, the ball valve. Apart from the check valve, the construction of the pump is essentially unchanged from the above-described embodiment. Hence the foregoing advantages of economical manufacture and assembly, few moving parts, and sharp on-off spray operation are common to this embodiment as well.

As still a further feature of the invention, the container is vented via the pumping chamber, with the vent opening to the pumping chamber lying axially inwardly of the pumping piston when the plunger is in the outer, or non-pumping, position. This arrangement assures rapid, positive priming of the pump during the initial pumping stroke of the plunger and also serves to prevent leakage of fluid from either the pump or the container during shipment and storage.

BRIEF DESCRIPTION OF THE DRAWINGS

For a better understanding of the invention, reference may be made to the following description of exemplary embodiments thereof, taken in conjunction with the figures of the accompanying drawings, in which.

DETAILED DESCRIPTION

Figure 1:
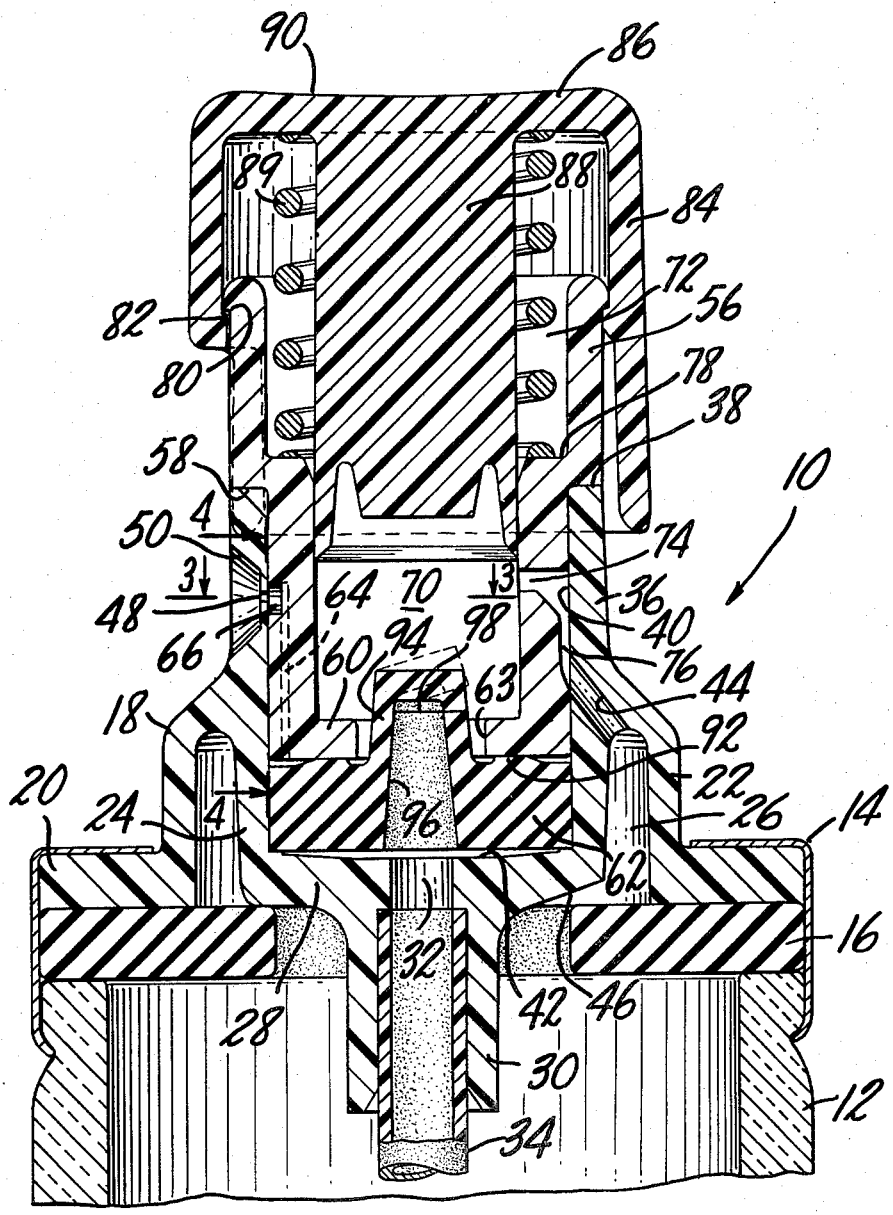
FIG. 1 is a vertical sectional view of one embodiment of the invention, showing the components thereof in the non-discharge position.

In the embodiment illustrated in FIG. 1, the pump 10 is shown attached to the neck of a container 12 by a crimped metal ferrule 14. A seal ring 16 is captured between the axially inner end of the pump and the axially outer end of the container 12.

The pump housing 18 may of course take any outward configuration required by the container to which it is to be attached and typically would be generally circular to facilitate threading or crimping to circular containers. In FIG. 1, therefore, the housing 18 is illustrated as including a circumferential flange 20 which cooperates with the ferrule 14 for attaching the pump 10 to the container 12. The flange 20 is integrally formed with the inner end of a circumferential outer wall 22 of the housing, the wall 22 being radially spaced from a circular inner wall 24 so as to form an annular recess 26. The radially inner wall 24 merges into an axial end wall 28, which itself merges into a depending boss 30 that extends axially downward from the end wall 28 and is formed with a central inlet opening 32 for the flow of the fluid to be dispensed from the container 12 to the pump 10. As is conventional, the boss 30 connects to a dip tube 34 extending into the container 12.

At this juncture, it should be noted that the housing 18 and the other components of the pump are preferably fabricated from a low cost thermoplastic such as polyethylene or polypropylene which lends itself to injection molding, extrusion, and other low cost, high quantity manufacturing processes. It will be understood, of course, that the actual material used should be compatible with the fluid to be dispensed. The seal-forming members, such as the seal ring 16 and the discharge valve member discussed hereinafter, are suitable made of nitrile rubber, EVA, PVC or the like, depending again on compatibility with the fluid being dispensed.

In the outward direction, the outer and inner circumferential walls 22 and 24, respectively, merge to form a single circumferential wall 36 which terminates at its outer end in an axially outwardly facing shoulder 38. Interiorly thereof, the circumferential walls 24 and 36 together define a generally cylindrical bore 40 that is open at its axially outer end and that is bounded at its axially inner end by the end wall 28. As illustrated in FIG. 1, the axially outer surface of the end wall 28 is undercut over the central region 42 thereof for a purpose hereinafter described.

As also shown in FIG. 1, a vent duct 44 is formed in the housing 18 to connect the annular recess 26 with the bore 40 for purposes of venting the container 12. This is described more fully hereinafter. As shown in the left hand side of FIG. 1, the seal ring 16 preferably overlaps and seals the outer end of recess 26 except at a number of circumferentially spaced locations, as illustrated at 46 in the right hand side of FIG. 1, where the end wall of the housing 18 is undercut to establish communication between the recess 26 and the interior of container 12.

Circumferentially spaced from the vent duct 44 and extending radially through the outer wall 36 of the housing 18 is an outlet port 48 which, on the outlet side, merges into a radially outwardly flared recess 50 for shaping and directing the spray. As perhaps best seen in FIG. 3, a radially protrusion 52 is formed on either side of the recess 50 so as to form circumferentially facing shoulders 54. As described more fully hereinafter, the shoulders 54 function both as locater surfaces in the assembly of the pump components and as guide surfaces during the use thereof.

Referring now again to FIG. 1, a barrel 56 is axially received within the bore 40 of the housing 18. The barrel 56 is generally cylindrical in cross section and of an enlarged diameter over the axially outer portion thereof so as to provide a circumferential shoulder 58 which seats against the shoulder 38 on the housing 18. With the barrel 56 and housing 18 so assembled, the inner end wall 60 of the barrel is axially spaced from the inner end wall 28 of the housing, thereby providing a chamber for receipt of a valve gland 62. The inner wall 60 of the barrel 56 is formed with a central opening 63 for fluid communication between the interior of the barrel and the valve chamber and, in the embodiment of FIGS. 1–4, for receipt of an axially extending stem, described hereinafter, on the valve gland 62.

Figure 3:
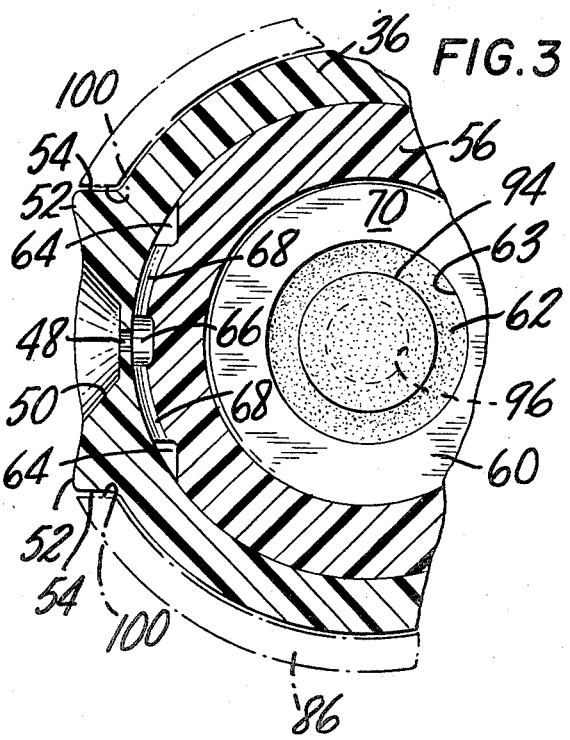
FIG. 3 is a partial horizontal sectional view taken along the line 3—3 in FIG. 1 and looking in the direction of the arrows.
Figure 4:
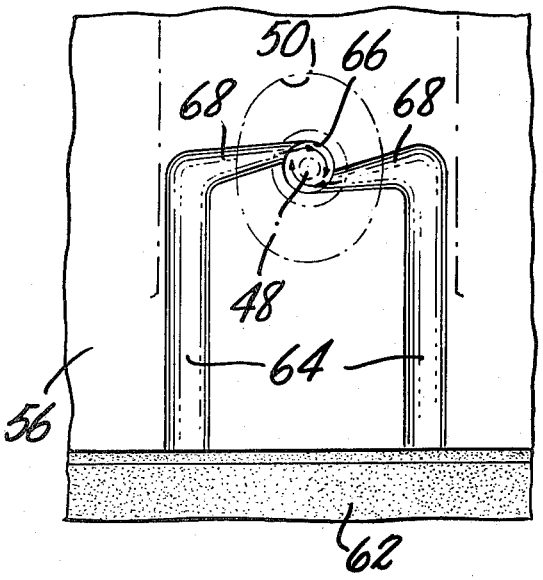
FIG. 4 is a partial vertical sectional view taken along the line 4–4 in FIG. 1 and looking in the direction of the arrows.

As illustrated in FIG. 1 and more completely shown in FIGS. 3 and 4, a pair of axially extending grooves 64, a circular recess 66 and a pair of connecting circumferential grooves 68 are formed in the outer surface of the barrel 56 for the purpose of connecting the outlet port 48 in the housing 18 to the valve chamber. The circular recess 66 is so located relative to the shoulder 58 on the barrel 56 as to coincide axially with the outlet port 48 in the housing 18 when the barrel 56 is inserted into the chamber 40 in the manner shown in FIG. 1. Circumferential positioning of the recess 66 in alignment with the outlet port 48 is facilitated during assembly by the shoulders 54 on the housing wall 36, which during assembly are used as locater surfaces for assuring that the correct annular orientation between the housing 18 and the barrel 56 is achieved.

Interiorly, the barrel 56 defines a chamber 70 (see FIG. 1) of reduced diameter over the axially inner portion thereof and a chamber 72 of increased diameter over the axially outer portion thereof, thereby forming an outwardly facing shoulder 78 at the juncture between the two portions. A radial port 74 and an axial groove 76 in the wall of the inner portion of the barrel 56 connect the reduced-diameter chamber 70 to the vent duct 44 in the housing 18. At its axially outer end, the barrel 56 is formed with a circumferential shoulder 80 which is adapted to coact with a cooperating shoulder 82 on the depending circumferential wall 84 of a plunger 86. The plunger 86 includes a central piston 88 which is slidably received within the chamber 70 of the barrel 56. In order to form a tight seal between the inner end of the piston 88 and the walls of the chamber 70, the inner piston end preferably flares radially outward so as to establish an interference fit with the walls of the chamber. To facilitate sliding of the piston 88 relative to the barrel 56, the plunger 86 suitably is made of polyethylene or like material of low frictional resistance. A coil spring 89 captured between the outwardly facing shoulder 78 on the barrel 56 and the outer end wall of the plunger 86 normally urges the plunger 86 to the axially outer position illustrated in FIG. 1. As will be appreciated, the plunger 86 and piston 88 may be reciprocated relative to the barrel 56 by hand, and for that purpose a finger depression 90 may conveniently be molded into the outer surface of the plunger 86.

Figure 2:
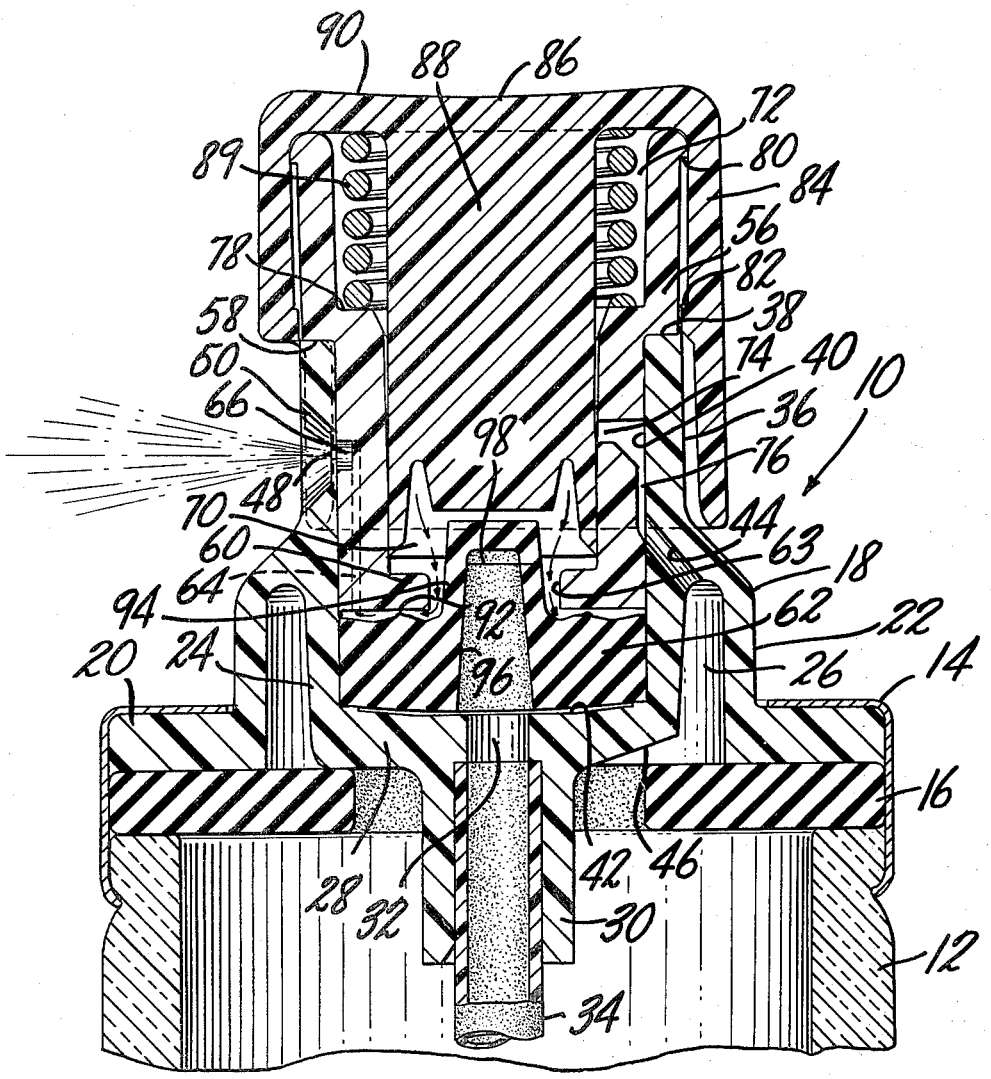
FIG. 2 is a vertical sectional view of the embodiment of FIG. 1, but showing the pump components in the discharge or dispensing position.

Turning now briefly to the valve gland 62, it may be seen from FIGS. 1 and 2 that the gland is generally circular in plan and generally T-shaped in axial cross section. The axially inner end wall of the gland 62 rests against the end wall 28 of the housing 18 and, in the relaxed state of the gland, defines a clearance with the end wall 28 over the area of the undercut 42. The diameter of the gland 62 is such that a tight seal is formed between the circumferential side wall of the gland and the cylindrical inner wall 24 of the housing 18. On its axially outer wall, the gland 62 is formed with a circular sealing lip 92 which, in the relaxed state of the gland shown in FIG. 1, establishes a tight seal with the facing surface of the inner end wall 60 of the barrel 56 in surrounding relation to the opening 63 connecting the valve chamber to the chamber 70 within the barrel.

The central stem 94 of the gland 62 extends axially outwardly into and through the opening 63 in the inner wall 60 of the barrel 56. A blind passageway 96 extends axially through the base of the gland and into the stem 94. A transverse slit 98 near the axially outer end of the stem 94 permits the closed end wall of the stem to pivot axially outwardly, as illustrated in phantom in FIG. 1, to act as a check valve during operation of the pump.

As illustrated in FIGS. 1 to 3, the circumferential wall 84 of the plunger 86 is notched axially in the region of the shoulders 54 on the housing 18, thereby providing shoulders 100 on the plunger in opposed relation to the shoulders 54 on the housing 18 for purposes of guiding axial movement of the plunger during use.

In the normal storage position, the components of the pump will be in the positions illustrated in FIG. 1. It is to be noted that the axially inner end of the piston 88 is located outwardly of the vent duct 74 in the barrel, thereby sealing the vent duct against leakage of fluid from the container 12 during shipment or storage. Such location of the piston relative to the vent duct 74 also provides rapid priming of the pump during use, since any air bubbles in the pumping chamber will be blown into the vent duct 74 upon inward movement of the piston 88.

In operation, if the chamber 70 is originally empty of fluid, it will be filled with fluid during the initial stroke or two of the plunger 86. As will be appreciated, this occurs on the outward movement of the plunger 86 during which the end wall of the stem 94 of the gland 62 is caused to pivot in the manner shown in phantom in FIG. 1, thereby permitting fluid flow from the container 12 through the slit 98 and into the chamber 70. When the plunger reaches the full outer limit of its stroke, the end wall of the stem 94 returns to the normally closed position of FIG. 1. Assuming then that the chamber is filled with liquid, on the next in-stroke of the plunger 86, pressure will begin to build up within the chamber 70 until it is sufficiently high enough to overcome the resilience of the gland 62 and, as illustrated in FIG. 2, cause the gland to deform axially into the undercut 42. The fluid in the chamber 70 is thereupon free to pass the sealing lip 92 and enter the ducts 64 and 68, the recess 66 and the outlet port 48. As illustrated in FIG. 4, the connecting ducts 68 preferably enter the recess tangentially on opposite sides thereof so as to impart a spiral movement to the fluid for purposes of improving atomization of liquids.

As indicated in FIG. 2, when the plunger 86 is depressed the radially flared inner end thereof passes inwardly of the vent port 74 in the barrel 56, thereby opening the container 12 to the atmosphere via the undercut 46 and the duct 44 in the housing 18, the axial groove 76 and the port 74 of the barrel 56, and the natural clearance existing between the depending circumferential wall 84 of the plunger and the upper portion of the barrel. The end flap of the gland 62 is of course closed throughout the inward stroke of the plunger, thereby preventing the back flow of fluid to the container 12.

A significant advantage of the design of the gland 62 is that it affords a sharp on-off operation, thus affording prompt full-strength sprays and essentially dripless shut off. This result is achieved through the sudden breaking of the seal between the lip 92 on the gland and the end wall 60 of the barrel when the pressure within the chamber 70 has built up sufficiently to overcome the resilience of the gland 62. When this occurs, the fluid pressure within the chamber 70, theretofore acting only over the area of the gland within the diameter of the seal lip 92, is abruptly applied across the full area of the gland 62 and causes it to move sharply to the deformed state shown in FIG. 2 and to remain in such state until the fluid pressure within the valve chamber has fallen below the resilient force of the gland tending to return it to its relaxed state. When the pressure within the valve chamber has so fallen off, the gland 62 snaps shut, thereby sharply cutting off fluid flow to the outlet port 48. The resistance to flow through the ducts 64, 68 and through the inlet port 48 is sufficient to maintain the fluid pressure within the valve chamber high enough to overcome the resilience of the gland 62 until the piston 88 has nearly reached the inner end of its travel (shown in FIG. 2). With no further manual pressure being applied to the plunger 86, the pressure within the valve chamber at this point drops rapidly, whereupon the gland 62 will return to its relaxed state (shown in FIG. 1) and sharply shut off flow to the outlet port 48. An added advantage of the valve gland 62 as illustrated in FIGS. 1 to 4 is that it incorporates into a single integral unit both the discharge structure for controlling the dispensing of the fluid and the check valve structure for controlling the flow of the fluid from the container to the pumping chamber 70. This has the obvious advantage of simplifying and reducing the number of parts required for the pump, and additionally permits the elimination of all metal-fluid contact. This is desirable, for example, for applications where the use of metal check valves or other elements in contact with the fluid is incompatible with the fluid itself.

Upon release of the plunger, the spring 89 urges the plunger 86 to the outer position shown in FIG. 1, thereby refilling the pumping chamber 70 by virtue of fluid flow through the dip tube 32, the inlet opening 30, the passageway 96 and the slit 98. Similarly, upon outward movement of the plunger, the flared inner end of the piston 88 again closes off the vent port 74 in the barrel 56 to prevent leakage or spillage of the fluid. It will also be appreciated that the embodiment of FIGS. 1 to 4 is useful in any position, i.e., upright, on its side or even upside down, since the operation of the check-valve structure of the gland 62 is substantially unaffected by gravity.

Figure 5:
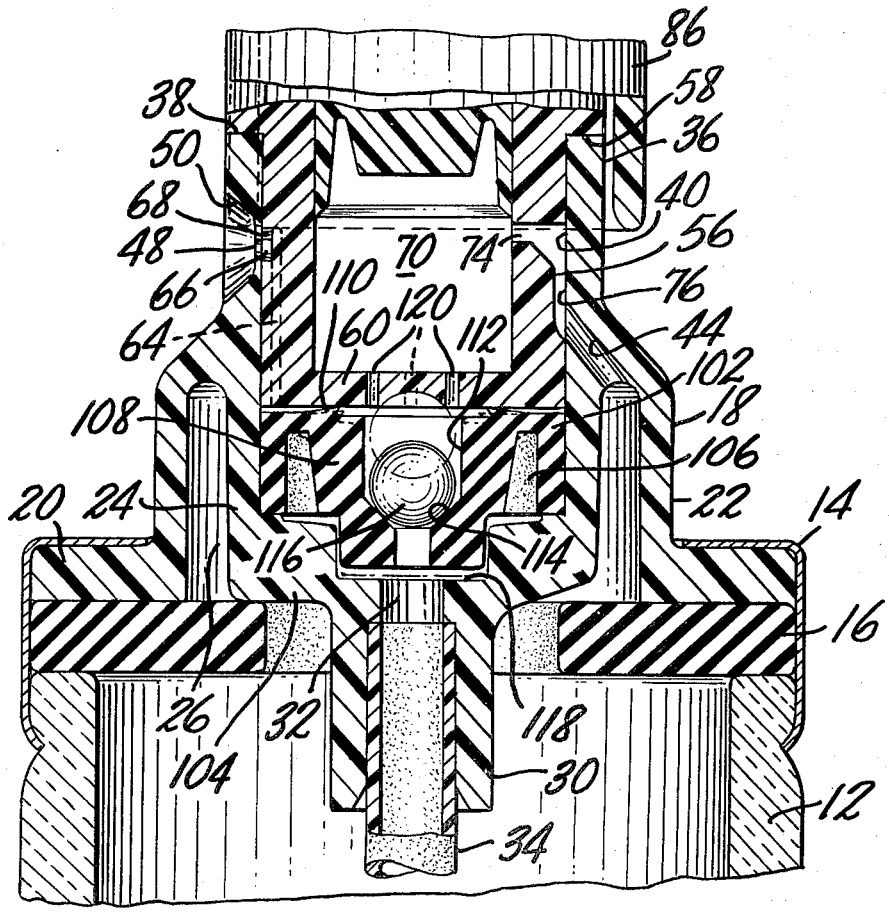
FIG. 5 is a vertical sectional view of a second embodiment of the invention, showing the pump components in the non-dispensing position and with parts broken away for clarity of illustration.

As illustrated by the embodiment of FIG. 5, the present invention lends itself to use with a check valve of the ball type if desired. As the embodiment of FIG. 5 is essentially the same as that of FIGS. 1 to 4, like reference numerals are used to designate like parts. Referring first to the valve gland 102, it may be seen that the gland is received within the valve chamber defined between the inner end wall 60 of the barrel 56 and the inner end wall 104 of the housing 18. Similarly, it engages the inner wall of the bore 40 within the housing. In this embodiment, the gland 102 is formed with an axially extending, annular recess 106 adjacent the periphery thereof. This recess permits the central body 108 of the gland to be displaced axially (as indicated in phantom in FIG. 5) in response to the build up of fluid pressure within the chamber 70, thereby breaking the seal between the circular sealing lip 110 formed on the axially outer surface of the gland and the inner end wall 60 of the barrel 56 so as to permit fluid flow from the chamber 70 to the inlet port 48, just as described in connection with the embodiment of FIGS. 1 to 4. The gland 102 is formed with a central, through passageway 112 which is tapered in a well known manner to form a valve seat 114 for coaction with a ball valve 116. If desired, the central body 108 of the gland may be axially lengthened in the inward direction in the region of the ball check valve, and, if so, the end wall 104 of the housing 18 is suitably undercut at 118 to provide clearance for deflection of the body of the valve during the dispensing stage. The single fluid opening 62 through the end wall 60 in the embodiments of FIGS. 1 to 4 is shown replaced in the embodiment of FIG. 5 with a number of smaller openings 120. This in no way changes the function of the barrel 56, but merely safeguards against displacement of the ball valve 116 into the pumping chamber 70. Except for the check valve, the operation of the embodiment of FIG. 5 is essentially unchanged from that of FIGS. 1 to 4. In particular, it will be understood that the same advantage of sharp on-off operation, which results from the sudden increase in area of the gland over which the fluid pressure acts during the inward stroke of the plunger, is attained in both embodiments.

Although the invention has been described above with reference to specific embodiments thereof, many modifications and variations of such embodiments may be made by one skilled in the art without departing from the inventive concepts disclosed. Accordingly, all such modifications and variations are intended to be included within the spirit and scope of the appended claims.

I claim:

1. A fluid dispensing pump comprising: a housing adapted to be connected to a container holding a fluid to be dispensed, said housing defining interiorly thereof a generally cylindrical bore having (1) a fluid inlet port in the axial inner end wall thereof for communication with the container, (2) a fluid outlet port opening through a side wall thereof, and (3) an open axially outer end;

a generally cylindrical barrel received within the open outer end of said bore, the axially inner end wall of the barrel being spaced from the axially inner end wall of the bore to define therebetween a generally cylindrical valve chamber, said barrel defining interiorly thereof a generally cylindrical pumping chamber having (1) at least one opening through the axially inner end wall thereof for communicating with the valve chamber and (2) an open axially outer end;

a generally cylindrical piston received within the open outer end of said pumping chamber for reciprocation therein between an axially outer position and an axially inner position;

resilient means for returning said piston to said axially outer position;

a resilient, generally cylindrical valve member located in said valve chamber and having (1) an axial passageway therethrough for establishing fluid communication between the inlet port in the housing and said pumping chamber and (2) a generally circular sealing lip on the axially outer end wall thereof for establishing, in the relaxed state of said valve member, a fluid-tight seal with the axially inner end wall of the barrel in surrounding relation to said at least one opening therethrough, said valve member being axially deformable from said relaxed state in response to the build up of fluid pressure within said pumping chamber by reciprocation of said piston to an inwardly deflected state at which said sealing lip is at least partially out of engagement with the inner end wall of the barrel, thereby permitting fluid flow from the pumping chamber to the outlet port; and check valve means for (1) closing the passageway through the valve member upon inward movement of the piston and (2) opening said passageway to permit fluid flow therethrough upon outward movement of the piston.

2. The pump of claim 1 wherein said check valve means comprises flap-valve means integrally formed with said valve member.

3. The pump of claim 2 wherein said flap-valve means comprises:

an axially outwardly extending stem located centrally of said valve member, said passageway extending into said stem from the axially inner end of said valve member too close to the axially outer end of said stem; and a slit in said stem adjacent the axially outer end thereof and communicating with said passageway, said slit opening upon outward movement of said piston to permit fluid flow through said passageway to said pumping chamber and closing upon inward movement of said piston to check fluid flow through said passageway.

4. The pump of claim 1 wherein said check valve means comprises:

means in said passageway defining a ball valve seat; and a ball valve member for coacting with said ball valve seat for opening and closing said passageway as aforesaid.

5. The pump of claim 1 wherein:

the axially inner end of said valve member abuts against the axially inner end wall of the valve chamber adjacent the periphery thereof, a clearance being provided between the respective axially inner end walls of the valve member and the valve chamber to permit said axially deformation of the valve member.

6. The pump of claim 1 wherein:

the generally cylindrical side wall of the valve member sealing engages the generally cylindrical side wall of the valve chamber; and said circular sealing lip on the axially outer end wall of the valve member is spaced radially inwardly of the generally cylindrical side wall of said member such that the cross sectional area of the valve member encircled by said sealing lip is substantially less than the overall cross sectional area of said member, whereby the fluid pressure within said pumping chamber acts only across the smaller area of said valve member encircled by said sealing lip when said valve member is in the relaxed state and acts across substantially the entire cross sectional area of said valve member when said valve member is in said deflected state.

7. The pump of claim 1 further comprising means for venting the interior of the container during inward movement of the piston, said venting means including a vent duct in the barrel opening into the pumping chamber at a location intermediate to said axially inner and axially outer positions of the piston.

* * * * *